US006651838B2

(12) United States Patent
Bissell

(10) Patent No.: US 6,651,838 B2
(45) Date of Patent: Nov. 25, 2003

(54) BOTTLE RETAINING DEVICE TO AID POURING

(76) Inventor: Frederick J. Bissell, 2427 Gulf Dr., Fairfield, CA (US) 94533

( * ) Notice: Subject to any disclaimer, the term of this patent is extended or adjusted under 35 U.S.C. 154(b) by 92 days.

(21) Appl. No.: 10/105,566

(22) Filed: Mar. 26, 2002

(65) Prior Publication Data

US 2003/0183640 A1 Oct. 2, 2003

(51) Int. Cl.[7] ..... A47J 45/00; B65D 23/10

(52) U.S. Cl. ..... 220/741; 220/742; 220/756; 220/755; 294/31.2; 294/33; 215/395

(58) Field of Search ..... 220/741, 742, 220/755, 756; 294/31.2, 33; 215/395; 248/311.2

(56) References Cited

U.S. PATENT DOCUMENTS 3,610,671 A * 10/1971 Conger ..... 294/33
4,486,043 A * 12/1984 Rais ..... 294/27.1
4,669,627 A * 6/1987 Ueda et al. ..... 220/741
4,842,158 A * 6/1989 Reyes, Jr. ..... 222/470
4,896,913 A * 1/1990 Kennedy ..... 294/31.2
4,982,869 A * 1/1991 Robbins, III ..... 220/742
5,013,074 A * 5/1991 Galle ..... 294/33
5,183,169 A * 2/1993 Grzych ..... 215/395
5,580,343 A * 12/1996 Cafiero ..... 482/139
6,543,825 B1 * 4/2003 Dragutin ..... 294/31.2

* cited by examiner

*Primary Examiner*—Joseph Man-Fu Moy

(57) ABSTRACT

Bottle retaining device to aid pouring with a bottle retaining frame made of resilient, injection molded plastic such as polypropylene or the like, an inverted T shaped handle attached to the bottle retaining frame, the handle capable of being held in a vertical or horizontal position, the bottle retaining frame including an integral resilient strip connected to a C shaped bottle neck holding portion, and the bottle retaining frame including a flat base portion and a plurality of horizontally disposed ring portions and a plurality of vertical ribs that connect to said ring portions that enable the user to removably retain a standard two liter beverage bottle from said retaining frame. A preferred embodiment includes wherein said pouring aid handle can be gripped by one hand at its lowest horizontal bar member and said beverage bottle cradled from the underside by the user's second hand thereby allowing the weight of said beverage bottle to be shared by both hands and to be easily grasped and controlled by said hands whether they be that of a small child or of an adult who may be suffering from arthritis or the like.

4 Claims, 5 Drawing Sheets

BOTTLE RETAINING DEVICE TO AID POURING

BACKGROUND OF THE INVENTION

This invention relates generally to the field of bottle holders, and more particularly to bottle retaining device to aid the process of pouring.

Currently, many beverages are sold in standard two liter sized bottles.

Typically these bottles are blow molded from a thin walled plastic such as food grade PET. A two liter bottle weighs several pounds and can be rather unwieldy in the hands of a young child or in the hands of an older person who may suffer from arthritis or the like. Because of the thin wall construction of most beverage bottles, even strong, healthy adults may have trouble pouring a beverage from a full two liter bottle because the plastic container can compress and deform in one's hands thereby making the pouring process difficult.

A number of bottle holding devices have been developed over the years. These holding devices typically are comprised of a base plate and a surrounding structure and a vertically oriented handle. However, there is a deficiency in prior designs because, even though the vertical type handle can help a person lift and pour from a beverage bottle, the gripping position is rather awkward because the handle is offset to one side and there is no provision for the user to easily share the weight with both hands during the pouring process.

SUMMARY OF THE INVENTION

The primary object of the invention is a bottle retaining device that helps a person to hold a beverage container securely while pouring a liquid from said beverage container.

Other objects and advantages of the present invention will become apparent from the following descriptions, taken in connection with the accompanying drawings, wherein, by way of illustration and example, an embodiment of the present invention is disclosed.

Bottle retaining device to aid pouring comprising: a bottle retaining frame made of resilient, injection molded plastic such as polypropylene or the like, an inverted T shaped handle attached to said bottle retaining frame, said handle capable of being held in a vertical or horizontal position, said bottle retaining frame including an integral resilient strip connected to a C shaped bottle neck holding portion, and said bottle retaining frame including a flat base portion and a plurality of horizontally disposed ring portions and a plurality of vertical ribs that connect to said ring portions that enable the user to removably retain a standard two liter beverage bottle.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
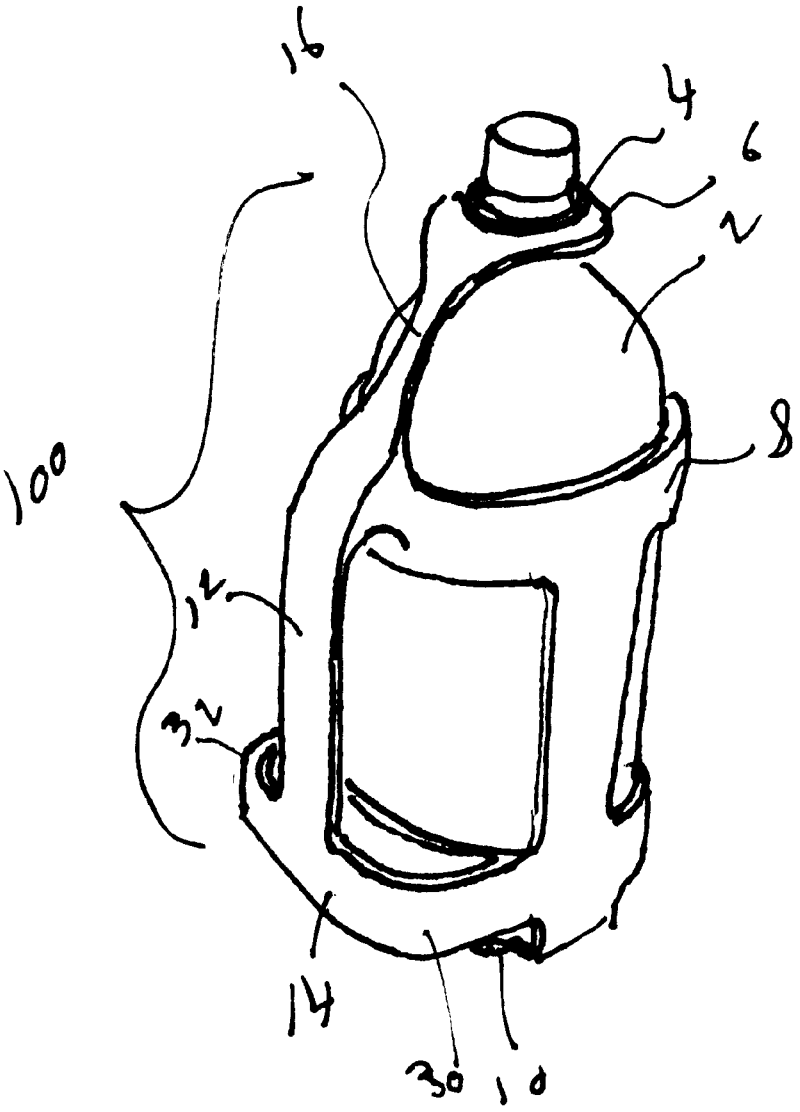
FIG. 1 is a perspective view of the bottle holder of the present invention.
Figure 2:
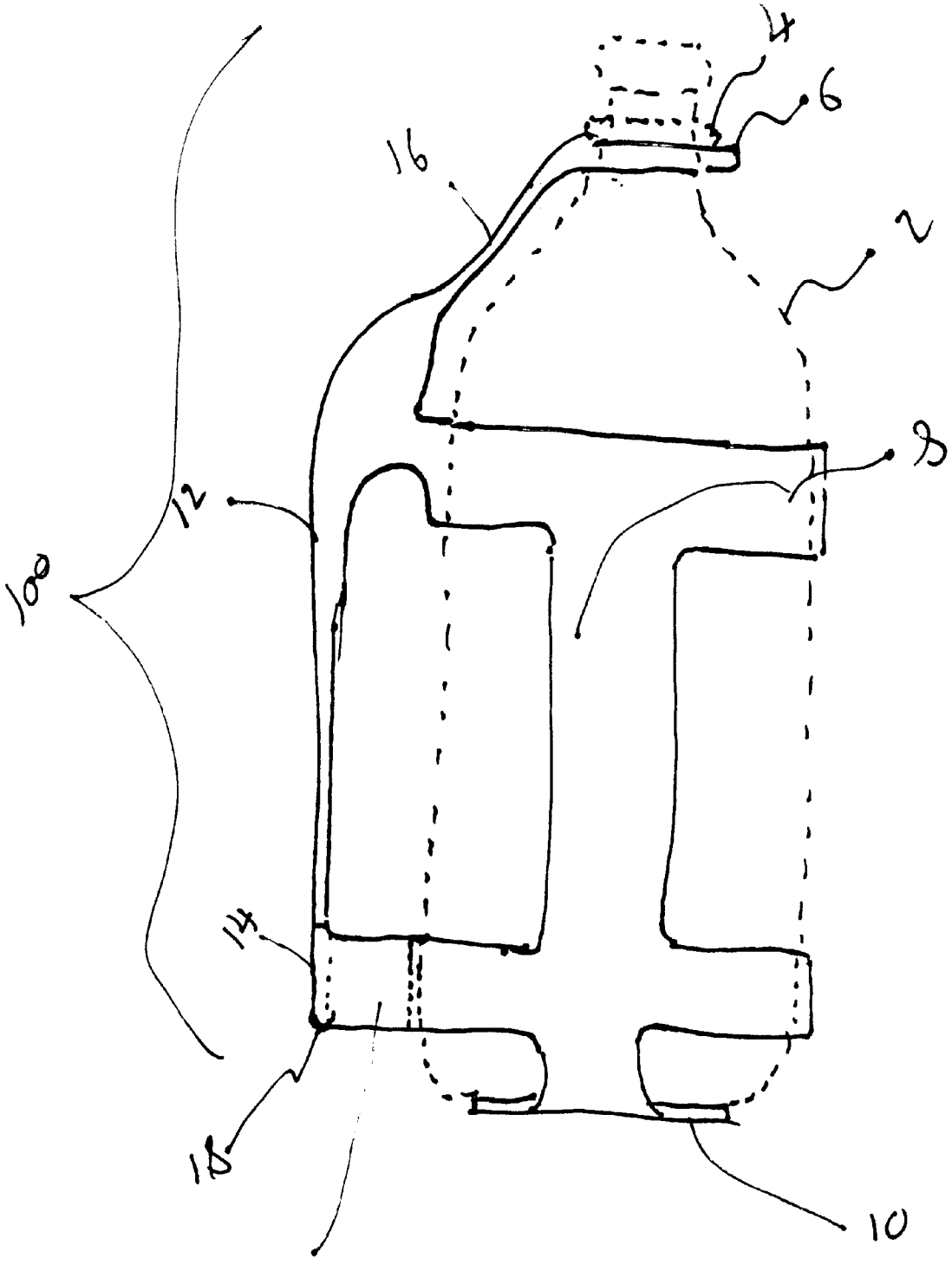
FIG. 2 is a side view of the present invention
Figure 3:
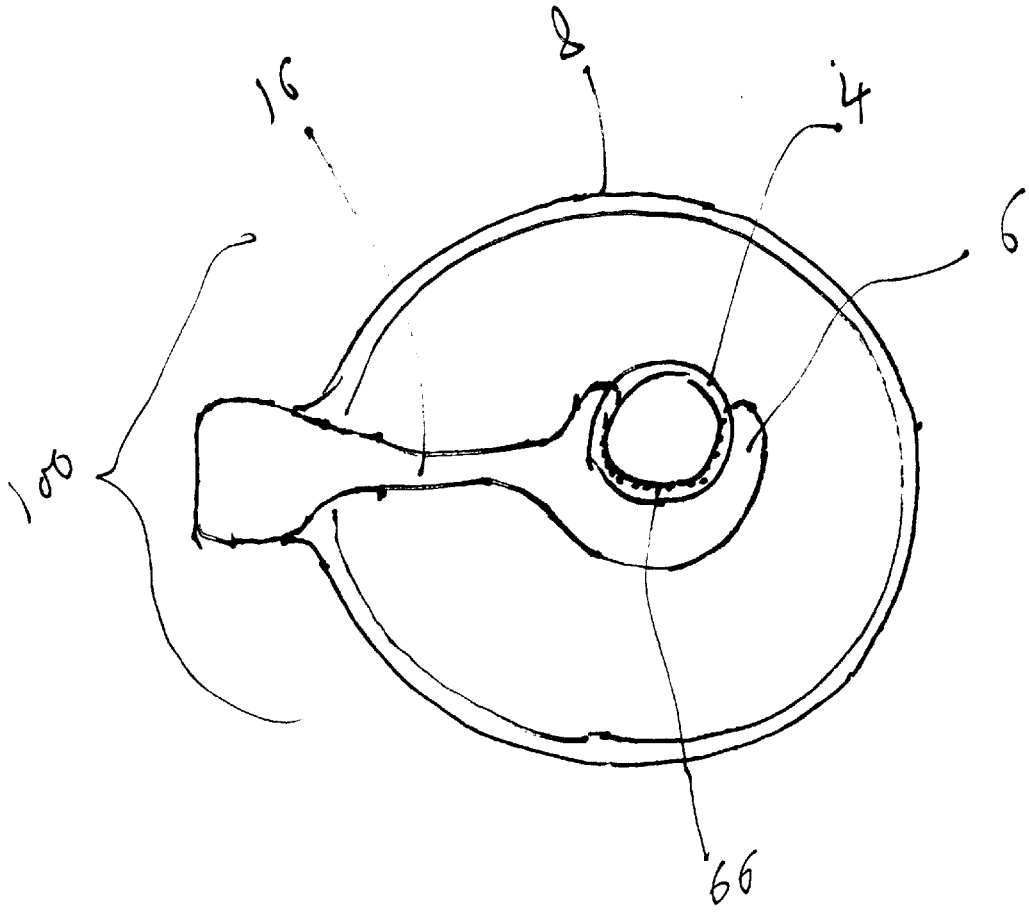
FIG. 3 is a top view of the present invention
Figure 4:
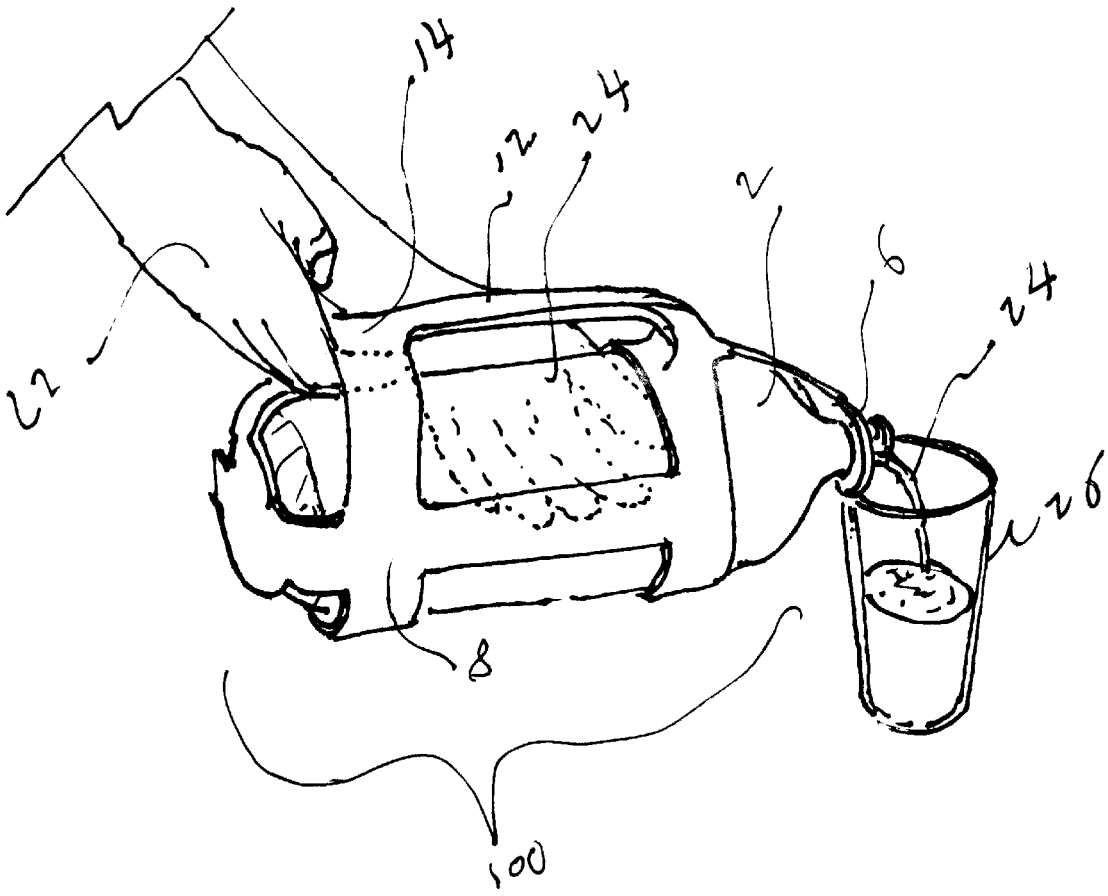
FIG. 4 is a perspective view of a person using two hands to pour a beverage from a two liter bottle using the present invention.
Figure 5:
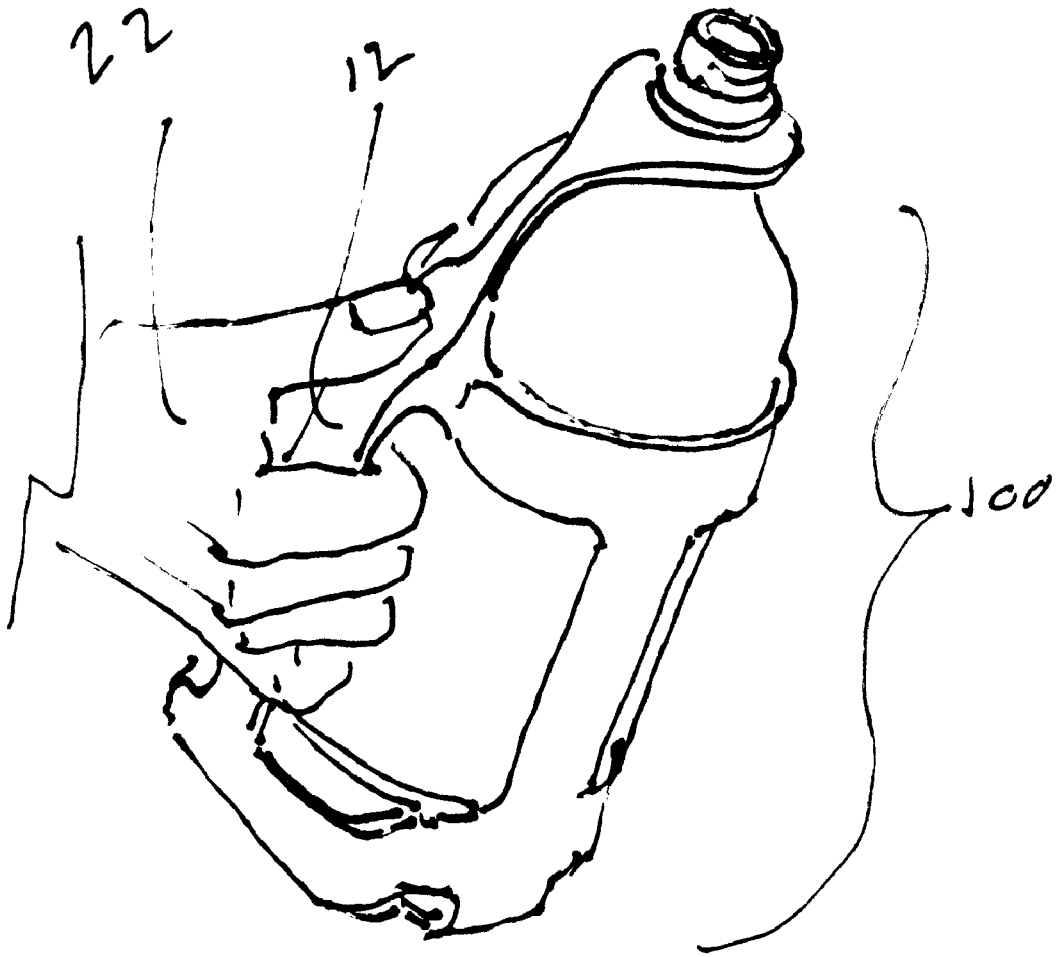
FIG. 5 is a perspective view of a person holding the vertical portion of the handle of the present invention.

Referring now to FIG. 1 we see a perspective view of the bottle retaining device of the present invention 1. We see a two liter plastic beverage bottle 2 being held by the present invention 100. Although the preferred embodient shows a two liter bottle, it should be understood that the spirit of the present invention relates to other sized bottles whether they be for beverages or some other pourable material. The bottle retainer 100 is injection molded from a plastic such as polypropylene or the like and is comprised of a frame made of a bottom plate 10 and a plurality of horizontal and vertical strips and integral rings 8 that act to retain a standard two liter bottle 2. Horizontal strip 14 extends beyond the bottle by approximately one inch and is held away from the bottle by integral side strips 30, 32. Vertical strip 12 extends upward from horizontal 14 and terminates at the upper ring of bottle retaining frame 8. The combination of vertical strip 12 and horizontal strip 14 form an inverted T shaped handle. A vertical strip 16 continues from the top of vertical strip 12 and terminates in a C shaped 6 bottle neck retainer that resides under the annular flange 4 found on the necks of most two liter plastic beverage bottles. Strip 16 is made thin at its central portion so that the strip is flexible enough to be pulled back by the user when inserting or removing a bottle from the present invention 100. FIG. 2 shows a side view of the present invention 100. Base plate 10 can be clearly seen. The lower portion of horizontal strip 14 is rounded so that when a person grips the underside of strip 14 during the pouring process, he or she does not experience the discomfort of a sharp edge. A two liter bottle is shown by dotted line 2. FIG. 3 shows a top view of the present invention 100. Strip 16 can be clearly seen and the C portion 6 at the end of strip 16 can be seen residing under bottle flange 4 as shown by dotted line 66. FIG. 4 shows a person using the present invention to help pour liquid 24 from beverage bottle 2 into glass 26. The user is holding the horizontal handle strip 14 with one hand 22 and cradling the underside of bottle 2 with the other hand shown by a dotted line 24. C shaped portion 6 is preventing the bottle 2 from sliding out of the main frame 8. This pouring position is ideal for children with small hands or adults with joint problems such as arthritis because the user does not have to grasp the entire diameter of the bottle when pouring. The act of pouring is made even more problematic because the sides of the bottle 2 can deform due to its thin wall construction. Additionally, the weight of the bottle and its contents is evenly distributed in both hands 22, 24. Finally, this pouring position gives the user maximum control of the pouring activity. FIG. 5 shows a person holding the vertical handle 12 of the present invention 100. The user can pour the beverage out in a more traditional one handed fashion if so desired even though this position is less stable than the one shown in FIG. 4.

The above described and illustrated bottle holding invention makes it possible for anyone, including small children and the elderly, to have control and comfort while pouring a beverage from a standard two liter plastic beverage container.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Bottle retaining device to aid pouring comprising:

a bottle retaining frame made of resilient, injection molded plastic;

an inverted T shaped handle attached to said bottle retaining frame;

said handle capable of being held in a vertical or horizontal position;

said bottle retaining frame including an integral resilient strip connected to a C shaped bottle neck holding portion; and said bottle retaining frame including a flat base portion and a plurality of horizontally disposed ring portions and a plurality of vertical ribs that connect to said ring portions that enable the user to removably retain a standard beverage bottle from said retaining frame.

2. Bottle retaining device to aid pouring as claimed in claim 1 wherein said pouring aid handle can be gripped by one hand at its lowest horizontal bar member and said beverage bottle cradled from the underside by the user's second hand thereby allowing the weight of said beverage bottle to be shared by both hands and to be easily grasped and controlled by said hands whether they be that of a small child or of an adult who may be suffering from arthritis or the like.

3. Bottle retaining device to aid pouring as claimed in claim 1 wherein said C shaped portion is positioned under a bottle top flange that is common to most one liter beverage containers thereby preventing a bottle from escaping from said bottle retaining device during the pouring process.

4. Bottle retaining device to aid pouring as claimed in claim 1 wherein said resilient strip is flexible enough to allow it to be pulled back in order to insert or remove said one liter bottle.

* * * * *